US008706016B2

(12) United States Patent
Imada et al.

(10) Patent No.: US 8,706,016 B2
(45) Date of Patent: Apr. 22, 2014

(54) FIXING DEVICE AND IMAGE FORMING APPARATUS INCORPORATING THE FIXING DEVICE

(75) Inventors: Takahiro Imada, Yokohama (JP); Masanao Ehara, Zama (JP); Tadashi Ogawa, Machida (JP); Satoshi Ueno, Komae (JP); Hiroshi Seo, Sagamihara (JP); Takamasa Hase, Kawasaki (JP); Kenji Ishi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 751 days.

(21) Appl. No.: 12/923,272

(22) Filed: Sep. 13, 2010

(65) Prior Publication Data

US 2011/0064490 A1 Mar. 17, 2011

(30) Foreign Application Priority Data

Sep. 14, 2009 (JP) ..... 2009-211204

(51) Int. Cl.
*G03G 15/20* (2006.01)

(52) U.S. Cl.
CPC ..... *G03G 15/2053* (2013.01)
USPC ..... 399/333; 399/328

(58) Field of Classification Search
USPC ..... 399/328–331, 333
See application file for complete search history.

(56) References Cited

U.S. PATENT DOCUMENTS

| | | | | |
|---|---|---|---|---|
| 5,832,354 | A | 11/1998 | Kouno et al. | |
| 5,915,147 | A | 6/1999 | Kouno et al. | |
| 6,219,520 | B1 | 4/2001 | Ehara | |
| 6,567,641 | B1 * | 5/2003 | Aslam et al. | 399/328 |
| 6,628,916 | B2 | 9/2003 | Yasui et al. | |
| 6,636,709 | B2 | 10/2003 | Furukawa et al. | |
| 6,778,790 | B2 | 8/2004 | Yoshinaga et al. | |
| 6,785,505 | B2 | 8/2004 | Yasui et al. | |
| 6,807,386 | B2 | 10/2004 | Yasui et al. | |
| 6,813,464 | B2 | 11/2004 | Amita et al. | |
| 6,881,927 | B2 | 4/2005 | Yoshinaga et al. | |
| 6,892,044 | B2 | 5/2005 | Yasui et al. | |
| 6,937,827 | B2 | 8/2005 | Katoh et al. | |
| 7,022,944 | B2 | 4/2006 | Yosjnaga et al. | |
| 7,266,336 | B2 | 9/2007 | Ueno et al. | |
| 7,270,910 | B2 | 9/2007 | Yahnker et al. | |
| 7,450,872 | B2 | 11/2008 | Ueno et al. | |
| 7,491,917 | B2 | 2/2009 | Ueno | |

(Continued)

FOREIGN PATENT DOCUMENTS

| | | | |
|---|---|---|---|
| JP | 2002049268 | A | 2/2002 |
| JP | 2006-154540 | A | 6/2006 |
| JP | 2008-040364 | A | 2/2008 |

OTHER PUBLICATIONS

English machine translation of JP 2002-049268 A.*

*Primary Examiner* — Walter L Lindsay, Jr.
*Assistant Examiner* — Ruth Labombard
(74) *Attorney, Agent, or Firm* — Harness, Dickey & Pierce, PLC

(57) ABSTRACT

An elastic layer is provided on a surface of one of a metal core and a substrate. A fixing member and a pressure member press into each other and collectively create a nip therebetween. A toner image is conveyed and fixed when passing through the nip. A thickness of the elastic layer is different in at least two widthwise regions by the same amount from the other region. A pair of edges of a prescribed size of the transfer sheet pass through these two widthwise regions, respectively.

8 Claims, 7 Drawing Sheets

(56) References Cited

U.S. PATENT DOCUMENTS

| | | | |
|---|---|---|---|
| 7,509,085 | B2 | 3/2009 | Yoshinaga et al. |
| 7,546,049 | B2 | 6/2009 | Ehara et al. |
| 7,693,439 | B2 | 4/2010 | Seo et al. |
| 7,715,774 | B2 | 5/2010 | Ueno |
| 7,734,208 | B2 | 6/2010 | Seo et al. |
| 7,742,714 | B2 | 6/2010 | Shinshi et al. |
| 7,778,581 | B2 | 8/2010 | Seo et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,817,952 | B2 | 10/2010 | Seo et al. |
| 7,885,590 | B2 | 2/2011 | Seo et al. |
| 2002/0018663 | A1 | 2/2002 | Furukawa et al. |
| 2002/0067936 | A1 | 6/2002 | Yasui et al. |
| 2003/0000933 | A1 | 1/2003 | Yoshinaga et al. |
| 2003/0007813 | A1 | 1/2003 | Yasui et al. |
| 2003/0016963 | A1 | 1/2003 | Yoshinaga et al. |
| 2003/0165348 | A1 | 9/2003 | Amita et al. |
| 2003/0206758 | A1 | 11/2003 | Yasui et al. |
| 2004/0042825 | A1 | 3/2004 | Yasui et al. |
| 2005/0074251 | A1 | 4/2005 | Katoh et al. |
| 2005/0095043 | A1 | 5/2005 | Yoshinaga et al. |
| 2005/0191098 | A1 | 9/2005 | Ueno et al. |
| 2006/0029411 | A1 | 2/2006 | Ishii et al. |
| 2006/0165443 | A1 | 7/2006 | Yoshinaga et al. |
| 2006/0257183 | A1 | 11/2006 | Ehara et al. |
| 2006/0285893 | A1 | 12/2006 | Ishii |
| 2006/0289419 | A1 | 12/2006 | Ueno |
| 2007/0003334 | A1 | 1/2007 | Shinshi et al. |
| 2007/0014600 | A1 | 1/2007 | Ishii et al. |
| 2007/0059003 | A1 | 3/2007 | Shinshi et al. |
| 2007/0059011 | A1 | 3/2007 | Seo et al. |
| 2007/0212089 | A1 | 9/2007 | Seo et al. |
| 2007/0264060 | A1 | 11/2007 | Ueno et al. |
| 2007/0280754 | A1 | 12/2007 | Ogawa et al. |
| 2008/0025772 | A1 | 1/2008 | Seo et al. |
| 2008/0025773 | A1 | 1/2008 | Ito et al. |
| 2008/0044196 | A1 | 2/2008 | Seo et al. |
| 2008/0063443 | A1 | 3/2008 | Yoshinaga et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2008/0317532 | A1 | 12/2008 | Ehara et al. |
| 2009/0060550 | A1 | 3/2009 | Seo |
| 2009/0148204 | A1 | 6/2009 | Yoshinaga et al. |
| 2009/0148205 | A1 | 6/2009 | Seo et al. |
| 2009/0154966 | A1* | 6/2009 | Smith et al. ..... 399/328 |
| 2009/0245897 | A1 | 10/2009 | Seo et al. |
| 2009/0297197 | A1 | 12/2009 | Hase |
| 2010/0061753 | A1 | 3/2010 | Hase |
| 2010/0074667 | A1 | 3/2010 | Ehara et al. |
| 2010/0158553 | A1 | 6/2010 | Ueno |
| 2010/0178089 | A1* | 7/2010 | Fukuhata ..... 399/333 |

* cited by examiner

FIXING DEVICE AND IMAGE FORMING APPARATUS INCORPORATING THE FIXING DEVICE

CROSS-REFERENCE TO RELATED APPLICATIONS

This application claims priority pursuant to 35 USC §119 to Japanese Patent Application No. 2009-211204, filed on Sep. 14, 2009, the entire contents of which are herein incorporated by reference.

BACKGROUND OF THE INVENTION

1. Field of the Invention

The present invention relates to an image forming apparatus, such as a printer, a copier, a facsimile machine, a multi functional machine including functions of the printer and an image reading device, etc., and in particular, to a fixing device provided in the image forming apparatus.

2. Discussion of the Background Art

An image forming apparatus employing an electro-photographic system generally includes a drum or belt type photoconductive member as an image bearer, a charge device, and an exposure device, each arranged around the photoconductive member. The image forming apparatus further includes a developing device, a cleaning device, and a charge-removing device, also disposed around the photoconductive member. Specifically, the surface of the photoconductive member is uniformly charged, and an exposure process is executed to form a latent image thereon corresponding to text or an image to be printed or the like. Then, the latent image is developed into a visible toner image using toner. The toner image is transferred onto a transfer sheet either directly or indirectly via an intermediate transfer belt. The toner image on the transfer sheet is then fixed on the transfer sheet when passing through the fixing device, thereby printing is completed.

The fixing device includes a fixing member, such as a fixing roller, a fixing sleeve, a fixing belt, etc., and a pressure member, such as a pressure roller, etc. The fixing member and the pressure member contact and press into each other thereby forming a nip therebetween, through the transfer sheet is bearing the toner image is conveyed. Thus, the toner image on the transfer sheet is heated, pressed, and fixed in place on the transfer sheet when passing through the nip. A vicinity of a surface of one of the fixing member and the pressure member typically includes an elastic layer. Thus, in a conventional fixing device, when small size transfer sheets are repeatedly or normal size transfer sheets are longitudinally conveyed, portions of the surface layer at edges of the transfer sheet become rough and thereby edge marks are created. Subsequently, when a larger size transfer sheet is fed in such a situation, the edge marks are transferred onto that large image.

To resolve such a problem, avoiding lines in the image or uneven glossiness, a fixing device of Japanese Patent Application Laid Open No. 2008-40364 (JP-2008-040364-A) employs a refreshing roller that rotatavely engages with surface of a fixing roller to make a large number of friction cuts in the surface of the fixing roller and thereby make the surface of the fixing roller uniform. Further, although it does not improve the surface roughness created by passage of the transfer sheet, JP-2006-154540-A employs a cleaning roller in a fixing device to contact and erase contact marks on the surface of a fixing belt created by a contact-type temperature probe contacting the fixing belt.

Both of the above-mentioned approaches employ another member that contacts the surface of the fixing member to either reduce the surface roughness or to remove steins or dirt thereon. However, with this technology, when transfer sheets of a small size are repeatedly conveyed or normal size transfer sheets are longitudinally conveyed, portions on the surface of a fixing member or a pressure member corresponding to edges of the transfer sheet are roughened and lines drawn thereat, creating lines in images on large size transfer sheets as a problem to be resolved.

The above-mentioned problem occurs in a nip created by the fixing member and the pressure member pressing into each other on their surfaces where edges of a transfer sheet pass through due to concentration of stress thereat, induced in proportion to a thickness of the transfer sheet. Consequently, when a fixing belt or sleeve having an elastic surface layer on a metal substrate is employed and a thick transfer sheet is conveyed through the nip, the substrate of the fixing belt or sleeve is likely to be either deformed or damaged due to the concentration of stress on the positions corresponding to edges of the transfer sheet, producing an abnormal image.

SUMMARY OF THE INVENTION

The present invention has been made in view of the above noted and another problems and one object of the present invention is to provide a new and noble fixing device. Such a new and noble fixing device fixes a toner image onto a transfer sheet. The fixing device includes a fixing member and a pressure member. One of the fixing member and the pressure member includes one of a metal core and a substrate as well as an elastic layer overlying the one of a metal core and a substrate. The fixing member and the pressure member press into each other and creates a nip therebetween. The toner image is conveyed and fixed onto the transfer sheet when passing through the nip. The elastic layer has regions of different thickness where edges of a prescribed size of the transfer sheet pass through at the nip, respectively.

In another aspect, the regions has four widthwise regions of the different thickness from the other region, where edges of the at least two prescribed sizes of the transfer sheets pass through, respectively. The widthwise regions have substantially the same length in an axial direction of the fixing device.

In yet another aspect, the region of different thickness of the elastic layer are rectangular or curved in cross section.

In yet another aspect, the elastic layer includes at least one pair of regions of increased thickness where edges of at least one prescribed size of the transfer sheet pass through.

In yet another aspect, one of a metal core and a substrate includes regions of reduced thickness where at least one prescribed size of the transfer sheet pass through. The regions of increased thickness are increased by the same amount by which the regions of the reduced thickness of the one of a metal core and a substrate are reduced in thickness.

In yet another aspect, the elastic layer includes regions of reduced thickness where edges of at least one prescribed size of the transfer sheet pass through.

In yet another aspect, the fixing member includes one of an endless belt and a sleeve having one of a metal core and a substrate as well as an elastic layer overlying the one of a metal core and a substrate. The elastic layer includes first regions of reduced thickness than the other region. One of a metal core and a substrate has second regions of increased thickness increased by the same amount by which the regions of reduced thickness of the elastic layer are reduced in thickness. The second regions face the first regions at the nip respectively. Edges of at least one prescribed size of the transfer sheet pass through the first and second regions at the nip.

In yet another aspect, a denting amount adjusting device is provided to adjust a denting amount by which the fixing member presses into the pressure member at the nip.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
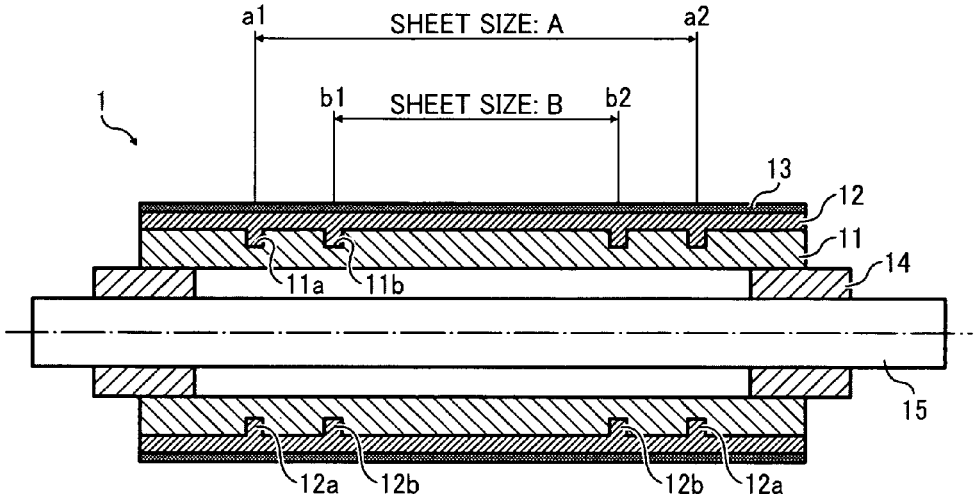
FIG. 1 illustrates a cross sectional view of an exemplary heating roller employed in a fixing device when viewed along a radius direction thereof according to a first embodiment of the present invention.

Referring now to the drawings, wherein like reference numerals and marks designate identical or corresponding parts throughout several figures, in particular in FIG. 1, a fixing device is described. As shown, a fixing device of the present invention includes a fixing member and a pressure member. One of the fixing member and the pressure member includes a metal core or a substrate and an elastic layer on a front side thereof, so that they press into each other and form a nip therebetween. Then, by conveying a transfer sheet having a toner image transferred thereon through the nip, the toner image is fixed thereonto.

Now, an exemplary pressure member is described with reference to FIGS. 1 and 2. The pressure device employed in the fixing device is generally called a pressure roller.

The pressure roller includes a cylindrical metal core 11 as a substrate, an elastic layer 12, such as silicon rubber, etc., overlying the front surface of the metal core 11, and a releasing layers 13 made of fluorine resin, such as PTFE, etc., for preventing offset. The metal core 11 is secured to a rotational shaft 15 via a pair of supporting sleeves 14.

The elastic layer 12 includes a different thickness at widthwise sections almost corresponding to edges of the transfer sheet passing through the pressure roller 1 from the other section. Specifically, when A and B size transfer sheets are fed (e.g. transfer sheets having A4 and A5 sizes (JIS) are longitudinally fed), a thickness of the elastic layer 12 is differentiated at sections almost corresponding to positions a1, a2, b1 and b2 within a prescribed width, where widthwise ends (i.e., edge sections) of the transfer sheets pass through the pressure roller 1, from the other sections.

The prescribed width extends in an axis direction of the pressure roller or the fixing roller including the corresponding positions at its center.

Further, a thickness of the elastic layer 12 is different from the others by changing in a rectangle state at the corresponding sections when viewed perpendicular to a movement direction of the surface of the pressure roller 1.

To produce the pressure roller, rectangular cross sectional grooves 11*a* and 11*b* are digged at the positions almost corresponding to a1, a2, b1 and b2 on the outer circumferential surface of the metal core 11 in its circular direction, and are inserted into a molding to mold a pressure roller from the metal core 11 and an elastic member, such as silicone rubber, etc. Then, a rubber thickness locally increases so that only sections 12*a* and 12*b* of the elastic layer 12 become thicker. Depth of the grooves 11*a* and 11*b* is preferably determined as a prescribed level so that the metal core 11 does not significantly deforms when a prescribed amount of pressure is practically applied. The width of the grooves 11*a* and 11*b* is preferably determined considering unevenness of part precision and assembly. An external diameter of the pressure roller 1 is made constant over the entire length in the axial direction.

Thus, when transfer sheets having sizes A and B are longitudinally fed, stresses generated by both edges of the transfer sheets are absorbed and reduced by thicker sections 12*a* and 12*b* of the elastic layer 12. As a result, roughness on the surface of the pressure roller 1 caused by the above-mentioned edges of the transfer sheet and generation of the line images can be suppressed.

If the thickness of elastic layer 12 is simply increased at sections corresponding to the above-mentioned edge sections, the pressure roller 1 partially protrudes at the sections. Then, the sum of thickness of the metal core and the elastic roller 12 is made constant by decreasing the thickness of the metal core 11 at the sections, so that the external diameter of the pressure roller 1 can be constant over the entire width.

Now, a second embodiment is described with reference to FIG. 2. As shown, a cross sectional shape of the elastic layer 12 of the pressure roller 1 changes in a curved state at the above-mentioned corresponding sections. With such a configuration, a surface pressure does not change sharply in the axial direction in comparison with the first embodiment of FIG. 1. As a result, unevenness of the surface pressure gradually changes and an image can be stable.

To produce a pressure roller 1 of the second embodiment, grooves 11*e* and 11*f* having concaved curve bottom surfaces are digged at positions almost corresponding to those of a1, a2, b1 and b2 on the outer circumferential surface of the metal core 11 in its circular direction. Then, the metal core 11 is inserted into a molding to mold a pressure roller from the metal core 11 and an elastic member, such as silicone rubber, etc. As a result, a rubber thickness locally increases at the sections of the metal core 11 where the grooves 11*e* and 11*f* are digged, and accordingly, that of the elastic roller 12 increase at the sections 12*e* and 12*f* in a curved state. The remaining are the same as in the first embodiment of FIG. 1.

In addition to the above, the thickness of the elastic layer 12 can be changed at one and three or more sections corresponding to transfer sheet sizes or a width of the transfer sheet in its passage direction. In such a situation, the size is not limited to A4 or A5.

Further, when the metal core is relatively thin and a relatively thick transfer sheet is fed, the metal core 11 causes plastic deformation due to concentration of stress onto sections corresponding to edges of the transfer sheet, rather than due to abrasion of the front surface layer of the pressure roller 1. As a result, abnormal images are possibly created. In such a situation, the thickness of the elastic layer 12 is locally decreased at sections almost corresponding to positions a1 to b2 on the outer circumferential surface, while that of the metal core 11 is increased at the sections by an amount in proportion to the decreased amount. As a result, the plastic deformation of the metal core 11 can be avoided or suppressed.

Now, an exemplary fixing member is described.

Specifically, in addition to the above-mentioned pressure roller, a fixing roller can also employ the similar structure as the pressure roller as mentioned below. However, a heating source, such as a halogen heater, etc., is additionally arranged in the metal core 11 or a rotation shaft 15.

Such a fixing member can be obtained by arranging a fixing sleeve having similar layer construction as mentioned above overlying a sponge roller. The fixing member can also employ an endless fixing belt wound around heating and fixing rollers as described below with reference to FIGS. 3 and 4.

Figure 3:
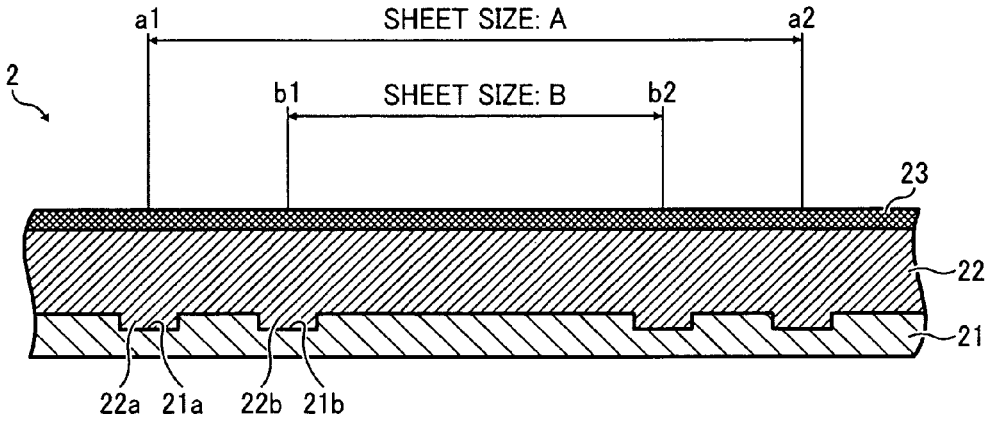
FIG. 3 illustrates a cross sectional view of an exemplary fixing roller or a fixing belt employed in a fixing device when viewed along a widthwise direction according to a first embodiment of the present invention.
Figure 4:
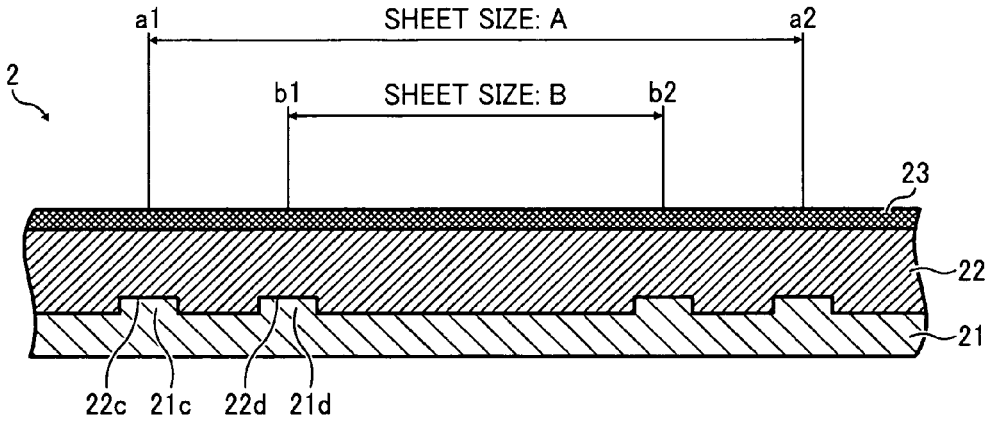
FIG. 4 illustrates a cross sectional view of the exemplary fixing roller or the fixing belt employed in a fixing device when viewed along a widthwise direction thereof according to a second embodiment of the present invention.

Specifically, the fixing belt 2 of the first and second embodiments of FIGS. 3 and 4 includes an elastic layer 22 made of such as silicone rubber, etc., overlying the front surface of the substrate 21, a releasing layer made of fluorine resin, such as PFA, PTFE, etc., coated overlying the surface of the elastic layer 22 for preventing offset. The substrate 21 includes a metal layer, such as SUS, nickel, aluminum, stainless, etc., when serving as a heating source in electromagnetic induction heating. Otherwise, the substrate 21 includes heat resistant resin, such as polyimide resin, polyamede resin, etc.

Similar to the above-mentioned embodiment of the pressure roller 1, the thickness of the elastic layer 22 is changed at positions thereof almost corresponding to the positions a1, a2, b1, and b2 where edge sections of the transfer sheets having sizes A and B are longitudinally fed through the pressure roller 1, for example, from the other position thereof.

To produce such a fixing belt 2 of the first example of FIG. 3, grooves 21*a* and 21*b* having a rectangular cross section are digged at positions almost corresponding to those of a1, a2, b1, and b2 on the front side of the substrate 21 in an outer circumferential direction of the fixing belt 2. Then, elastic material, such as rubber, etc., is coated onto the whole area of the front side of the substrate 21. Thus, a rubber thickness locally increases at the sections of the substrate 21 where the grooves 21*a* and 21*b* are digged, and accordingly, only the sections 22*a* of the elastic layer 22 increase thickness. Further, depth of the grooves 21*a* and 21*b* is preferably determined to be a prescribed level so that the substrate 21 does not significantly deforms when a prescribed pressure is practically applied. The thickness of the fixing belt 2 is constant both in the widthwise and lengthwise directions.

Further, to produce the fixing belt 2 of the second example of FIG. 4, protrusions 21*a* and 21*d* having rectangular cross sectional shape are formed in the vicinities on the corresponding positions on the substrate 21 in the outer circumferential direction of the fixing belt 2. Then, an elastic member, such as silicone rubber, etc., is coated onto the whole area of the substrate 21. Thus, the thickness of the substrate 21 locally increases at sections of the protrusions 21*c* and 21*d* and that of the rubber decreases, so that only sections 22*c* and 22*d* of the elastic layer 22 become thinner. The width of the protrusions 21*c* and 21*d* are preferably determined by considering fluctuation of deviation of passage of the transfer sheet in the main scanning. The thickness of the fixing belt 2 is again constant both in the entire lengthwise and widthwise directions.

The above-mentioned thickness of the elastic layer 22 and the substrate 21 can change in a curved state similar to the pressure roller 1 as described with reference to FIG. 2. In such a situation, a change and unevenness of the surface pressure in the widthwise direction of the fixing belt 2 can be gentle, and thereby an image can be stable as advantage.

The fixing sleeve is produced in a cylindrical state and includes the same construction as the fixing belt. However, the substrate 21 of the fixing sleeve includes a metal layer to serve as a heat generation layer causing electro magnetic induction heating. Operations and effects obtained by the construction are the same as the above-mentioned pressure roller and are mentioned later in detail.

Now, an exemplary fixing device having a denting amount adjusting member is described with reference to FIGS. 5 and 6.

Figure 2:
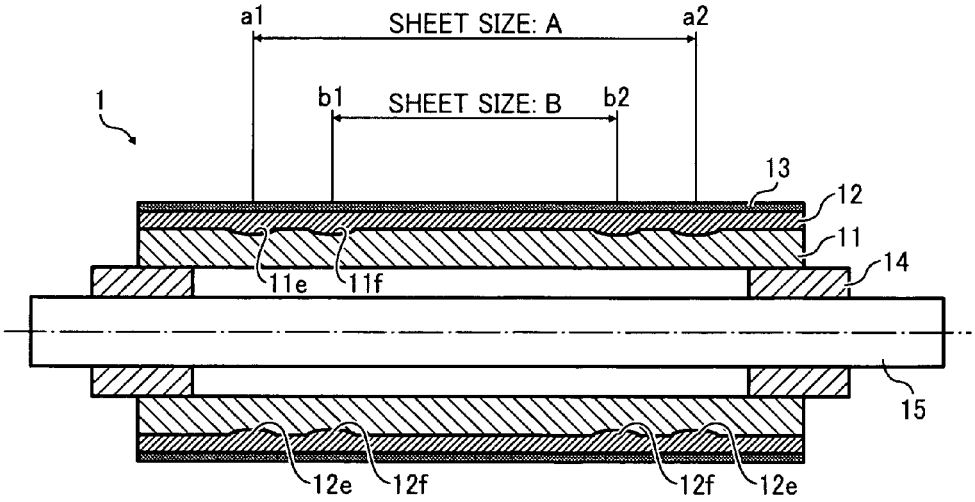
FIG. 2 illustrates a cross sectional view of an exemplary heating roller employed in a fixing device when viewed along a radius direction thereof according to a second embodiment of the present invention.

As shown, a pressure roller 1 has the same construction as that employed in one of FIGS. 1 and 2. Specifically, an elastic layer 12 made of silicone rubber or the like is coated onto the front surface of the metal core 11 of a metal cylinder. A releasing layer 13 made of fluorine resin is coated onto the surface of the elastic layer 12. Further, the metal core 11 is secured to a rotation shaft 15 via supporting sleeves 14. The rotation shaft 15 is supported movably both leftward and rightward.

Similar to the pressure roller 1, the fixing roller 3 is obtained by coating an elastic layer 32 made of silicone or the like onto the front surface of the metal core 31 serving as a substrate having a cylindrical shape made of aluminum or the like. Similar to the pressure roller 1 of the FIGS. 1 and 2, the thickness of the elastic layer 32 and the metal core 31 can locally increases at positions almost corresponding to edges of the transfer sheet of a prescribed size, which passes through the fixing member. Further, a heat generation source 34, such as a halogen heater, etc., is installed in the center of the metal core 31 in the axial direction. The heat generation source can also be installed within the metal core 11. Anyway, the rotational axis of the fixing roller 3 is stationed.

The denting amount adjusting device 4 includes a pressing lever, 41, a securing pin 42, and a guide lever 45. Also included are an eccentric cam 46, a fixed member 48, and a tension spring 49 of a tension coil type and the like. Specifically, the pressing lever 41 is swingably supported by loosely inserting the securing pin 42 into an oblong hole 41*a* formed on its base end with a play. The guide pin 44 arranged at a leading end of the pressing lever 41 on the front side in FIGS. 5 and 6 gently fits into an oblong hole 45*a* formed on the guide lever 45 pivotable around a pin 45*b*. A cam engages roller 43 is rotatably supported by the guide pin 44 on the opposite side of the guide lever 45.

The tension spring 49 is a tension coil type and is attached between the base end of the pressing lever 41 and the fixed member 48, so that a depressing section 41*b* formed on one side of the pressing lever 41 is biased to always engage with the supporting sleeve 14 protruding? in the direction of the rotational shaft 15 as shown in FIGS. 1 and 2, and so that the outer circumferential surface of the cam engaging roller 43 is biased to always engage with the outer circumferential surface of the eccentric cam 46 having a disc shape eccentrically secured to the rotational shaft 47. The rotation shaft 47 is driven and rotated by a motor, not shown.

Figure 5:
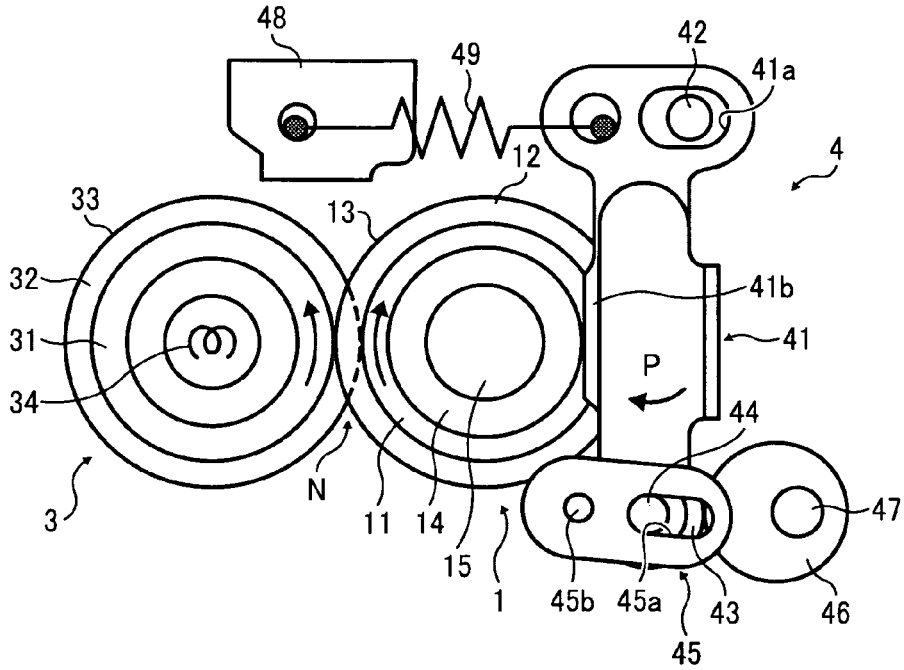
FIG. 5 schematically illustrates a normal pressing condition in the fixing device including a denting amount adjusting device according to one embodiment of the present invention.

FIG. 5 illustrates an ordinary pressing situation. Specifically, the eccentric cam 46 is located such that the farthest section of the outer circumferential surface from the rotation shaft 43 thereof engages with the outer circumferential surface of the cam-engaging roller 43. In this situation, the pressing lever 41 mostly swings in arrow P showing direction, and a pressure of the depressing section 41*b* against the pressure roller 1 becomes strongest. Thus, denting amount is mostly increased in a nip N where the outer circumferential of the fixing roller 3 and the pressure roller 1 engages with each other.

In such a condition, a transfer sheet having a toner image transferred thereon is generally conveyed toward the nip section N (i.e., in an arrow N showing direction) from the lower section of FIG. 5, and is sandwiched by the fixing roller 3 and the pressure roller 1 in arrows showing directions. Thus, the toner image is fixed by heat and pressure onto the transfer sheet. At that time, stress concentration created by the edges of the transfer sheet are absorbed and reduced at sections having a thicker elastic layer formed on one of the fixing roller 3 and the pressure roller 1.

However, when the line images are not sufficiently removed in the above, for example, when a transfer sheet thicker than a prescribed level is fixed, an amount of denting into the fixing roller 3 and the pressure roller 1 in the nip N is decreased so as to decrease an amount of stress therein in order to improve the above-mentioned problem.

Figure 6:
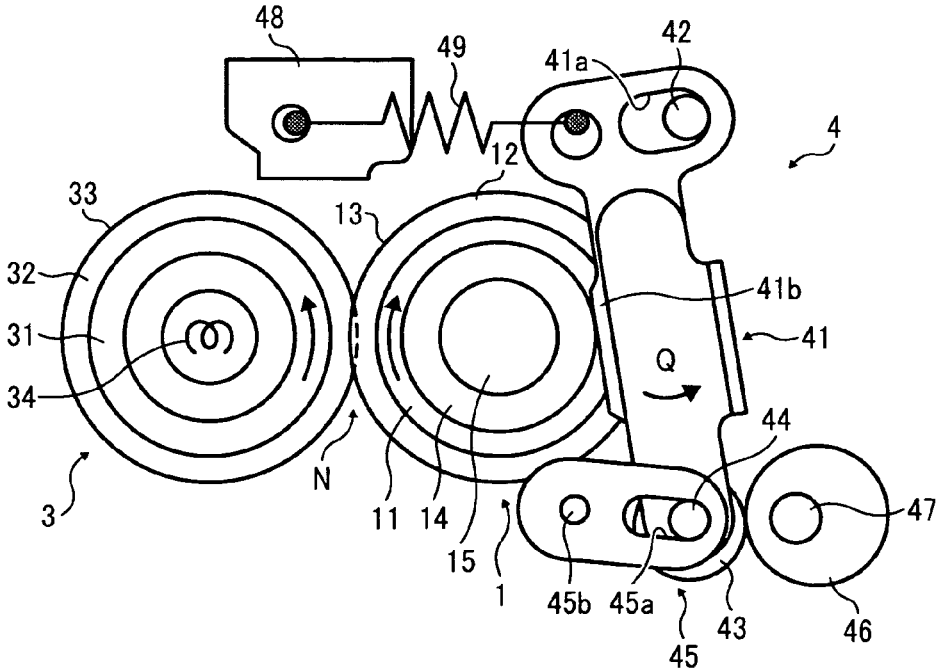
FIG. 6 schematically illustrates a pressure reduction condition in the fixing device of FIG. 5.

In such a situation, as shown in FIG. 6, the eccentric cam 46 is rotated by 180 degree from the position of FIG. 5 so that the nearest section of the outer circumferential surface of the cam 46 from the rotation shaft 47 thereof engages with the cam engaging roller 43. Thus, the pressing lever 41 mostly swings in an arrow Q showing direction so that a pressure of the depression section 41*b* against the pressure roller 1 becomes weakest. Thus, a denting amount is mostly decreased in the nip N. In such a situation, a conveyance velocity of the transfer sheet is decreased so that the transfer sheet receives compensation of calorie.

According to this fixing device, when the transfer sheet is a plain paper, a deviation amount of the pressure lever 41 caused by the eccentric cam 46 is maximum, so that the pressure roller 1 is mostly pressed into the fixing roller 3. Since a stress caused at edges of a thick transfer sheet is large, the edges of the elastic layer significantly wear or the substrate significantly deforms. In such a situation, a rotation angle of the eccentric cam 46 is adjusted top decrease an amount of pressure of the pressure roller 1 caused by the pressure roller 1, while decreasing the sheet conveyance velocity instead. As a result, calorie provide to the sheet is maintained and the stress on the edges can be decreased.

Further, when a rotation angle of the eccentric cam 46 is selected manually or automatically in accordance with a thickness of a transfer sheet carrying a toner image to be fixed, an amount of denting in the nip N can be adjusted between the maximum and minimum levels as shown in FIGS. 5 and 6. When the pressure is only applied to one end in the shaft direction of the pressure roller 1, since a denting amount possibly varies in the nip depending on a position in the shaft direction, the above-mentioned denting amount adjusting device 4 is arranged in each of the supporting sleeves arranged on the side ends of the pressure roller 1, so that the both ends can be equally pressed.

The denting amount adjusting device 4 can be provided in a different type of the above-mentioned fixing device, such as a fixing device that employs a fixing sleeve or a fixing belt as mentioned later in detail. With such a device, when the amount of denting and the stress in the nip N can be adjusted in accordance with a thickness of a transfer sheet carrying a toner image to be fixed, the line images can be more effectively suppressed.

Now, an exemplary fixing device including a fixing sleeve is described with reference to FIG. 7.

Figure 7:
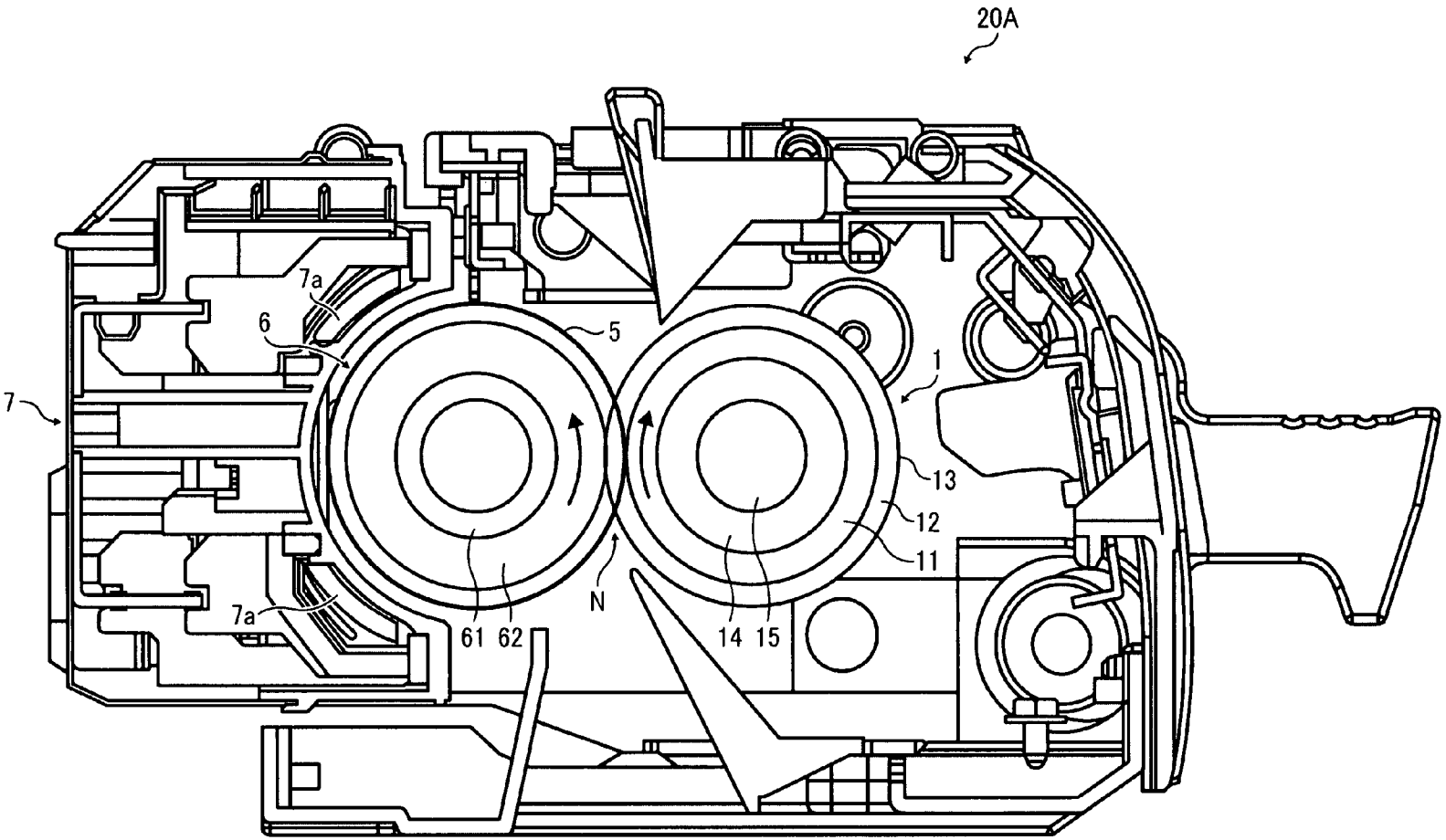
FIG. 7 illustrates an exemplary interior of the fixing device employing a fixing sleeve as a fixing member according to the one embodiment of the present invention.

As shown in FIG. 7, the fixing device 20A includes a pressure roller 1, a fixing sleeve 5 as a fixing device wrapping and overlying a sponge roller 6 and an electro magnetic induction heating section 7 for heating the fixing sleeve 5 in a casing. A nip N is formed by engaging the outer circumferential of the fixing sleeve 5 with that of the pressure roller 1 so that they dent each other.

The pressure roller 1 is preferably the same as described with reference to FIGS. 1 and 2. The rotation shaft 15 of the pressure roller 1 is supported to be able to move left and right wards as shown in FIG. 7, and is enabled to press against the outer circumferential surface of the fixing sleeve 5 when pressed by a biasing device such as a spring, not shown.

The sponge roller 6 includes a cylindrical metal core 61 that rotates at a prescribed fixed position and a thick sponge layer 62 made of heat insulation foam resin overlying the outer circumferential of the metal core 61. The fixing sleeve 5 is firmly attached and held on the outer circumference of the sponge layer 62 by a friction force or an adhesive force. The fixing sleeve 5 is a cylindrical having substantially the same layer structure as the fixing belt of FIG. 4, and includes an elastic layer made of silicon rubber or the like on the front surface side of the substrate. The surface of the elastic layer is coated with a releasing layer made of fluorine resin such as PFA, PTFE, etc., for preventing offset. The substrate includes a magnetic or non-magnetic metal layer (i.e., a heat generation layer) such as SUS, nickel, aluminum, stainless, etc., to generate heat when controlled by the electro magnetic induction heat generation section 7.

Since the substrate of the fixing sleeve 5 is possibly deformed by the edges of the thick transfer sheet, only positions of the substrate almost corresponding to the edges of the transfer sheet are made thicker and the elastic layer is instead made thinner by an amount in proportion thereto. Further, only positions of the elastic layer 12 of the pressure roller 1 almost corresponding to the edges of the transfer sheet may be made thicker as shown in FIG. 1 or 2, while the thickness of the metal core 11 is instead made thinner by an amount in proportion thereto.

Thus, stress concentration onto the fixing sleeve 5 by the edges of the thick transfer sheet can be reduced, and accordingly, deformation of the metal substrate can be suppressed. Further, when the fixing sleeve 5 is not adhered to the sponge roller 6, the fixing sleeve 5 can possibly deviate to one side in the shaft direction. Then, considering a deviation amount, a width corresponding to the edge needs to be determined.

Further, with the above-mentioned denting amount adjusting device as described with reference to FIGS. 5 and 6, the denting amount into the pressure roller 1 in the nip can be decreased when the thicker sheet is passed through. In such a situation, positions on the elastic layer of the fixing sleeve 5 almost corresponding to the edges of the transfer sheet may be made thicker, while the substrate is made thinner by an amount in proportion thereto as shown in FIG. 3.

The electro magnetic induction heating section 7 creates an alternation magnetic field by flowing high frequency alternation current into an arc shaped coil section 7*a* arranged adjacent to the fixing sleeve 5. Thus, due to an electric resistance, Joule heat is generated in the metal substrate of the fixing sleeve so that induction heating is executed. Thus, the fixing sleeve 5 rotating in an arrow showing direction is entirely heated, and a transfer sheet carrying a toner image is conveyed in an arrow N showing direction into the nip N between the pressure roller 1 and the fixing sleeve 5, so that the toner image is fixed onto the transfer sheet by heat and pressure.

Figure 8:
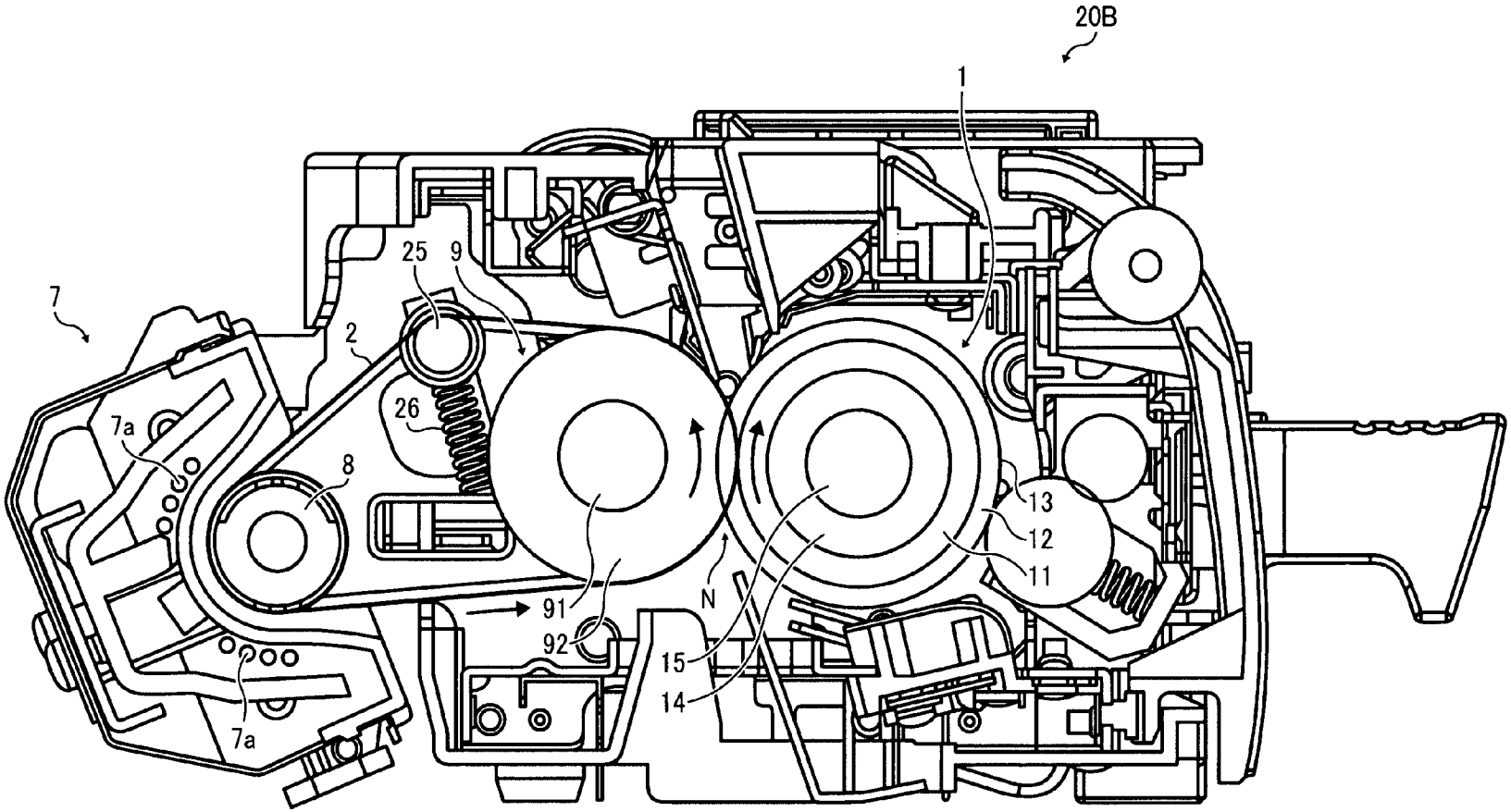
FIG. 8 illustrates an exemplary interior of the fixing device employing a fixing belt as a fixing member according to the one embodiment of the present invention.

Now, an exemplary fixing device including a fixing belt is described with reference to FIG. 8.

As shown, a fixing device 20B includes a pressure roller 1, a heating roller 8, and a fixing assistant roller 9 in a casing. Also included are a fixing belt 2 wound around the heating roller 8 and the fixing assistant roller 8, and an electro magnetic induction heating section 7 and the like. Further, outer circumferences of the fixing belt 2 and the pressure roller 1 dent each other, so that a nip N is created therebetween.

The pressure roller 1 has preferably the same configuration as described with reference to FIGS. 1 and 2. A rotation shaft 15 of the pressure roller 1 is freely movably supported left and right wards in the drawing, and is enabled by a biasing device such as a spring, etc., to press against the outer circumferential surface of the fixing belt. The reference 25 denotes a tension roller biased by a tension spring 26 to provide a tension to the fixing belt 2.

The fixing assistant roller 9 includes a metal core 91 made of stainless steel or the like and an elastic layer 92 made of silicone rubber or the like overlying the surface of the metal core 91. The fixing belt 2 is endless having the similar layer structure that as shown in FIG. 3. An elastic layer 22 made of silicone rubber or the like is formed on the front surface of the substrate 21. The surface of the elastic layer 22 is coated with a releasing layer 23 made of fluorine resin such as PFA, PTFE, etc., for preventing offset.

The heating roller 8 includes a heat generation layer made of non-magnetic metal or the like to generate heat when controlled by the electro magnetic induction heating section 7. Heat of the heating roller 8 travels and increases temperature of the fixing belt 2. The fixing belt 2 travels in an arrow showing direction in FIG. 8 and conveys the heat to the nip N, so that a fixing operation is executed in a similar manner as mentioned above with reference to FIG. 7.

Accordingly, the substrate 21 of the fixing belt 2 of FIG. 3 includes a heat resistant resin, such as polyimede, polyamide, etc., because of no need to generated heat when affected by the electro magnetic induction heating section 7. Thus, the substrate does not likely deform even when the thick sheet is fed. However, since edge roughening likely occurs on the surface of the fixing belt 2 at the time, only positions on the substrate 21 of the fixing belt 2 almost corresponding to edges of the transfer sheet are preferably made thinner while increasing the thickness of the elastic layer 22 by an amount in proportion to the thinning amount thereof as shown in FIG. 3.

As shown in FIGS. 1 and 2, only positions on the elastic layer 12 of the pressure roller 1 almost corresponding to the edges of the transfer sheet are preferably made thicker while decreasing the thickness of the metal core 11 by an amount in proportion to the thickening amount thereof. With such a configured, the stress concentration on the fixing sleeve 5 and the edge roughness on the surface of the fixing belt 2 each caused by the edges of the thick transfer sheet can be suppressed. Further, since the fixing belt 2 likely deviates to one side in a direction of the shaft of the fixing assistant roller 9, a width corresponding to the edge needed to be determined considering an amount of the deviation.

Figure 9:
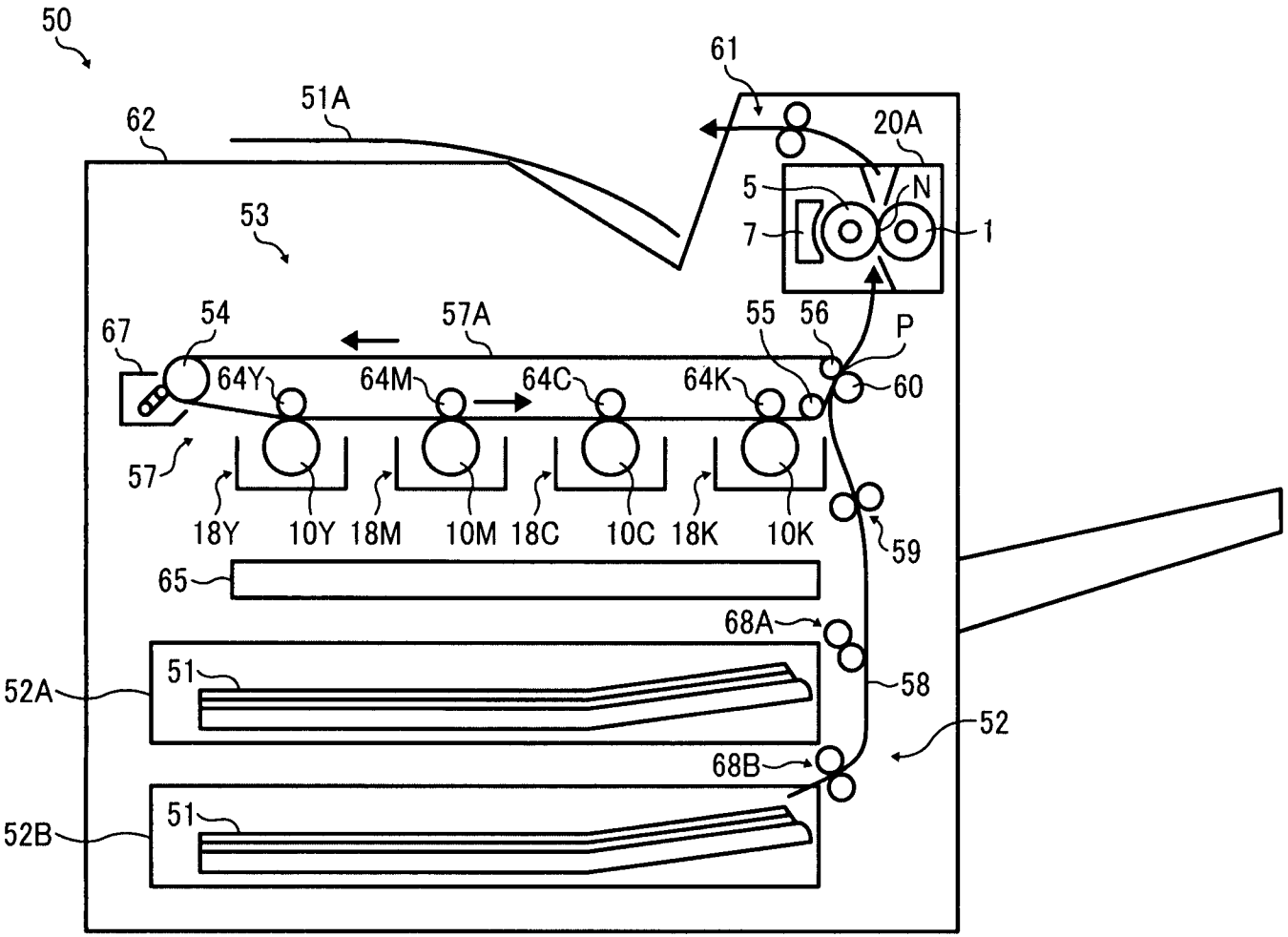
FIG. 9 schematically illustrates an exemplary overall structure of a color printer as one example of an image forming apparatus that includes the fixing device of the FIG. 7.
Figure 10:
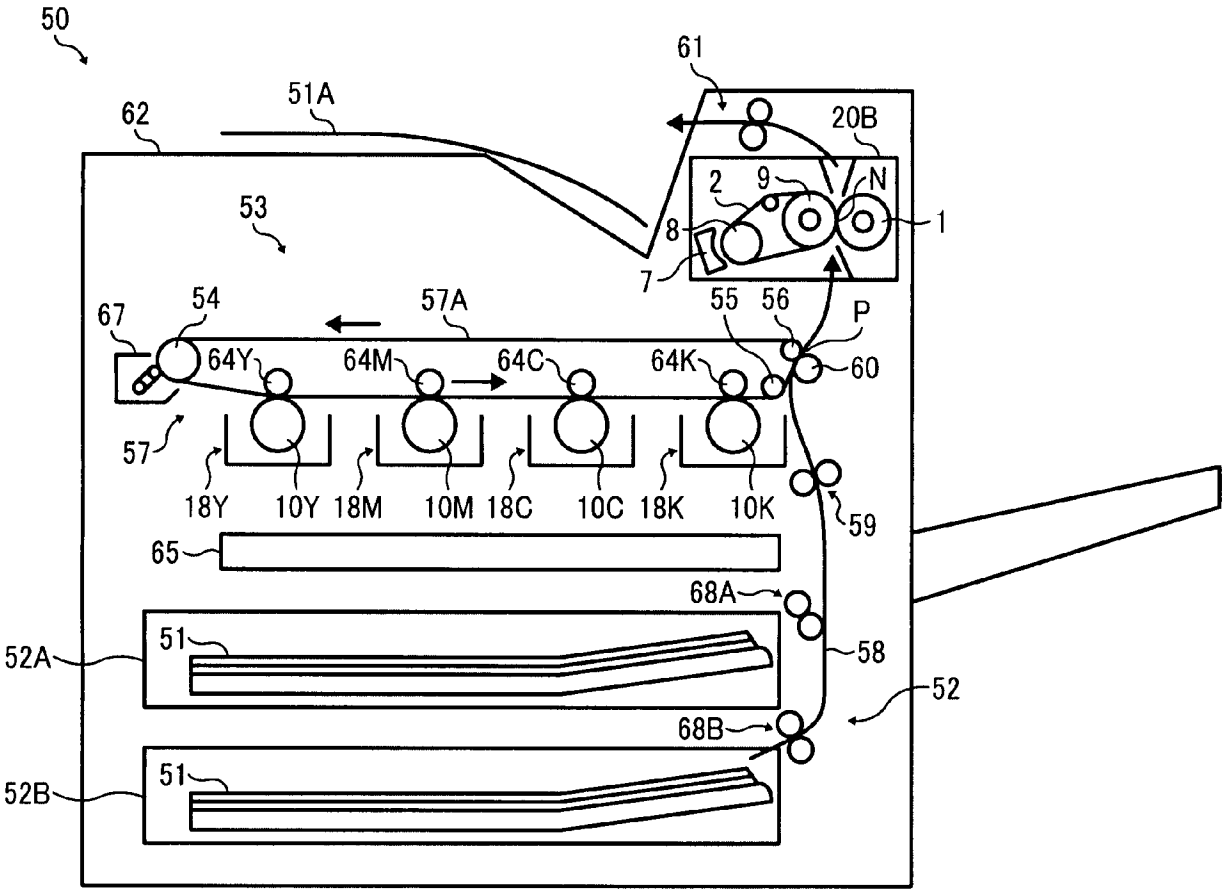
FIG. 10 schematically illustrates an exemplary overall structure of a color printer as one example of an image forming apparatus that includes the fixing device of the FIG. 8.

Now, an exemplary color printer as an image forming apparatus is described with reference to FIGS. 9 and 10.

As shown, the color printer includes a sheet feeding section 52 having sheet feeding trays 52A and 52B each for accommodating transfer sheets 51 as recording mediums in two steps in a lower section thereof, and an image formation section 53 arranged above the sheet feeding section 52.

The image formation section 53 includes image formation units 18Y to 18K having photoconductive drums 10Y to 10K as image bearers, respectively, an intermediate transfer unit 57 having an intermediate transfer belt 57A serving as an image bearer, and a writing unit 65 for executing optical writing on the respective photoconductive drums. Also included is a fixing device 20A for fixing a toner image transferred and not yet fixed on the transfer sheet 51. The fixing device 20A is as described in the above with reference to FIG. 7, and is detachable to and from a body of the image forming apparatus.

The intermediate transfer belt 57A is flexible and is wound around three rollers 54 to 56. Between the sheet feeding section 52 and the fixing device 20A, there is provided a conveyance path 58 having a conveyance roller for conveying the transfer sheet 51. In the image formation units 18Y to 18K, a known charge device, a known developing device, a given cleaning device are arranged around each of the photoconductive drums 10Y to 10K. The photoconductive drums 10Y to 10K are detachable from and to the body 50 of the image forming apparatus.

In the respective developing devices, toner of yellow, magenta, cyan, and black are stored. To each of the respective developing devices, applicable toner is replenished from a toner bottle when consumed. The intermediate transfer belt 57A is arranged opposing to the photoconductive drums 10Y to 10K, and is rotated counter clockwise in the drawing when any one of plural rollers is driven and rotated by a motor, not shown.

Opposing to the respective photoconductive drums 10Y to 10K, there are provided transfer rollers 64Y to 64K as primary transfer devices via the intermediate transfer belt 57A, receiving transfer biases, respectively. Opposing to a roller 54, a belt-cleaning device 67 is arranged to clean out the surface of the intermediate transfer belt 57A.

The intermediate transfer belt 57A, the plural rollers 54 to 56 rotating the intermediate transfer belt 57A, the transfer rollers 64Y to 64K, and the belt-cleaning device 67 are made into a unit detachable to and from the body 50 of the image forming apparatus. A secondary transfer roller 60 engages with the intermediate transfer belt 57A opposing to the roller 56 that receives a secondary transfer bias. The secondary transfer roller 60 and the intermediate transfer belt 57A partially face the conveyance path 58.

The writing unit 65 emits a laser light optically modulated to surfaces of the respective photoconductive drums 10Y to 10K to form latent images of respective colors. As shown, the writing unit 65 is arranged below the image formations 18Y to 18K to upwardly emit the laser light from the lower side of the body 50.

When image formation starts, the photoconductive drums 10Y to 10K are driven and rotated clockwise by driving devices, not shown, and the surfaces are uniformly charged in a prescribed polarity by the respective charge devices, not shown. The surfaces with the charges are then subjected to the laser light emitted from the writing unit 65, whereby latent images are formed.

At this moment, image information to be exposed onto the respective photoconductive drums includes monochrome image information obtained by resolving a prescribed full-color image into component colors of yellow to black. In this way, the latent images on the surfaces of the photoconductive drums 10Y to 10K are developed by respective color toner to be toner images.

When the intermediate transfer belt 57A is circulated counter clockwise by the driving device, not shown, the yellow toner image formed in the image formation unit 18Y arrange most upstream in the belt movement direction is transferred by the transfer roller 64Y. On the yellow toner image thus transferred, magenta, cyan, and black toner images formed in the respective image formation units 18M to 18K are transferred one by one by the transfer rollers 64M to 64K, whereby a full-color toner image is formed and carried on the surface of the intermediate transfer belt 57A.

The toner attracting to and remaining on the surfaces of the photoconductive drums 10Y to 10K are removed by cleaning devices, not shown. Then, the surfaces are subjected to charge removal processes of charge removing devices, not shown, and potentials are initialized to prepare for the next image formation.

When one of the sheet feeding rollers 68*a* and 68*b* is driven rotated, a transfer sheet 51 is fed and conveyed onto the conveyance path 58 from the sheet feeding section 52. The sheet 51 is then controlled by a pair of registration rollers 59 arranged on the conveyance path 58 on the sheet feeding side of the secondary transfer roller 60 to synchronize with a toner image. The sheet 51 is then fed to a transfer position P between the roller 56 and the transfer roller 60. The secondary transfer roller 60 receives a transfer voltage of a polarity opposite to a toner charge polarity of the toner image carried on the surface of the intermediate transfer belt 57A. Thus, the toner image on the intermediate transfer belt 57A is transferred by the secondary transfer roller 60 onto the transfer sheet passing through the transfer position P at once.

The transfer sheet with the toner image transferred is then conveyed to the fixing device 20A. Thus, the toner image is fused and fixed onto the transfer sheet by heat and pressure when passing through the nip N between the fixing sleeve 5 and the pressure roller 1. The transfer sheet 51A with the fixed toner image is then conveyed to a sheet ejection section 61 arranged at the end of the conveyance path 58, and is ejected onto a sheet ejection tray 62 arranged on the top of the body 50 from the sheet ejection section 61. The toner remaining on the intermediate transfer belt 57A after the toner image transfer process onto the transfer sheet 51 is removed by the belt cleaning device 67.

An exemplary modification of the printer is described with reference to FIG. 10. The modification is almost the same as the color printer of FIG. 8, and is only different in that the fixing device 20B described with reference to FIG. 8 is employed instead of that of 20A. However, the fixing device 20B is also detachable to and from the body.

The fixing device can employ the denting amount adjusting device as described with reference to FIGS. 5 and 6. Otherwise, the fixing device can be obtained by combining with a prescribed pressure device not mentioned heretofore.

Further, the image forming apparatus can be either a monochrome type or a full-color type.

According to one embodiment of the present invention, concentration of stress on edges of a transfer sheet that passes through a fixing nip. Accordingly, roughening on surfaces of a fixing member and a pressure member causing line images on an output is effectively suppressed. Further, deformation and damage on substrates of the fixing member and the pressure member can be reduced.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A fixing device for fixing a toner image onto a transfer sheet, said fixing device comprising:

a fixing member; and a pressure member, one of said fixing member and the pressure member having a uniform outer diameter and including one of a metal core and a substrate and an elastic layer of approximately uniform thickness overlying the one of a metal core and a substrate, said fixing member and the pressure member pressing into each other and creating a nip therebetween, said toner image being conveyed and fixed onto the transfer sheet when passing through the nip, said elastic layer including select regions where at least one of annular ribs or annular divots are located, the select regions being located where edges of at least one prescribed size of the transfer sheet pass through at the nip, respectively, wherein the annular ribs or annular divots have a curved cross section.

2. The fixing device as claimed in claim 1, wherein the select regions include at least four widthwise select regions each including one of an annular rib or an annular divot, where edges of the at least two prescribed sizes of the transfer sheets pass through, respectively, said widthwise select regions having substantially the same length in an axial direction of the fixing device.

3. The fixing device as claimed in claim 1, wherein said elastic layer includes at least one pair of select regions where edges of at least one prescribed size of the transfer sheet pass through.

4. The fixing device as claimed in claim 3, wherein the select regions of the elastic layer include the annular ribs, wherein said one of a metal core and a substrate include annular divots configured to accept each of the annular ribs of the elastic layer.

5. The fixing device as claimed in claim 1, further comprising a denting amount adjusting device configured to adjust a denting amount by which the fixing member presses into the pressure member at the nip.

6. An image forming apparatus comprising;

a housing; and a fixing device as claimed in claim 1, said fixing device being installed in the housing.

7. A fixing device for fixing a toner image onto a transfer sheet, said fixing device comprising:

a fixing member; and a pressure member, one of said fixing member and the pressure member having a uniform outer diameter and including one of a metal core and a substrate and an elastic layer of approximately uniform thickness overlying the one of a metal core and a substrate, said fixing member and the pressure member pressing into each other and creating a nip therebetween, said toner image being conveyed and fixed onto the transfer sheet when passing through the nip, said elastic layer including select regions where at least one of annular ribs or annular divots are located, the select regions being located where edges of at least one prescribed size of the transfer sheet pass through at the nip, respectively, wherein said fixing member includes one of an endless belt and a sleeve having one of a metal core and a substrate and an elastic layer overlying the one of a metal core and a substrate, wherein the select regions of said elastic layer include the annular divots, said one of a metal core and a substrate include annular ribs configured to engage each of the annular divots of the elastic layer, wherein edges of at least one prescribed size of the transfer sheet pass through the select regions at the nip.

8. An image forming apparatus comprising;

a housing; and a fixing device as claimed in claim 7, said fixing device being installed in the housing.

* * * * *